US006763217B2

(12) United States Patent
Bloemen et al.

(10) Patent No.: US 6,763,217 B2
(45) Date of Patent: Jul. 13, 2004

(54) SUBSTRATE GUIDE MEMBER WITH IMPROVED FLATNESS AND METHOD OF MAKING THE SAME

(75) Inventors: Peter J. M. Bloemen, Cuijk (NL); Wilhelmus Meijer, Velden (NL)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/322,114

(22) Filed: Dec. 17, 2002

(65) Prior Publication Data

US 2004/0114973 A1 Jun. 17, 2004

(51) Int. Cl.[7] ..... G03G 15/16
(52) U.S. Cl. ..... 399/316; 399/107; 399/388
(58) Field of Search ..... 399/107, 316, 399/322, 310, 388, 400; 72/302, 301

(56) References Cited

U.S. PATENT DOCUMENTS

| | | | | | |
|---|---|---|---|---|---|
| 4,525,057 | A | * | 6/1985 | Kaufmann et al. | 399/322 |
| 5,166,737 | A | * | 11/1992 | Tomita | 399/400 |
| 5,337,128 | A | * | 8/1994 | Hashizume et al. | 399/316 X |
| 5,687,297 | A | | 11/1997 | Coonan et al. | 395/102 |
| 5,749,035 | A | * | 5/1998 | Ban et al. | 399/316 |
| 5,752,134 | A | * | 5/1998 | Hazama et al. | 399/316 X |
| 6,069,624 | A | | 5/2000 | Dash et al. | 345/333 |
| 6,070,049 | A | * | 5/2000 | Hayashida | 399/400 |
| 6,216,521 | B1 | | 4/2001 | Heymes et al. | 72/302 |
| 2002/0064405 | A1 | * | 5/2002 | Tomiki et al. | 399/316 |
| 2003/0223787 | A1 | * | 12/2003 | Leute et al. | 399/316 |

FOREIGN PATENT DOCUMENTS

| | | | |
|---|---|---|---|
| JP | 04-182685 | * | 6/1992 |
| JP | 04-291276 | * | 10/1992 |
| JP | 09-022209 | * | 1/1997 |
| JP | 11-157695 | * | 6/1999 |

* cited by examiner

*Primary Examiner*—Sophia S. Chen
(74) *Attorney, Agent, or Firm*—Richard F. Spooner

(57) ABSTRACT

An improved substrate guide member and an improved method of manufacturing the same wherein slits are cut at the base of raised relief ribs prior to drawing such ribs. The result is a flatter and less expensive substrate guide member without the need for supplemental straightening processes.

32 Claims, 6 Drawing Sheets

FIG. 3
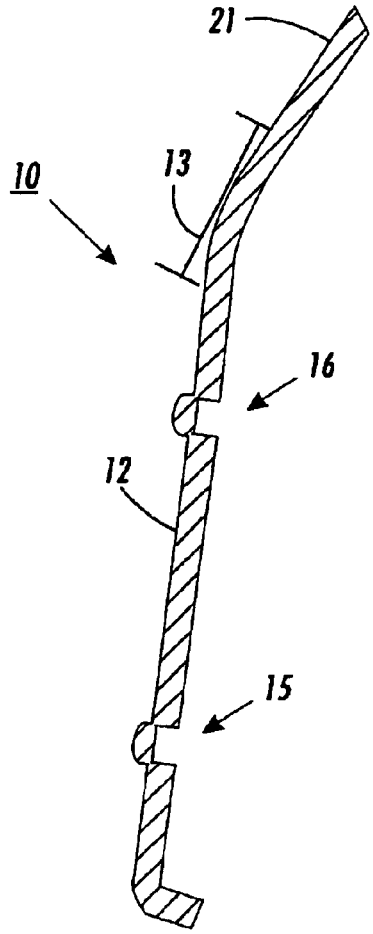
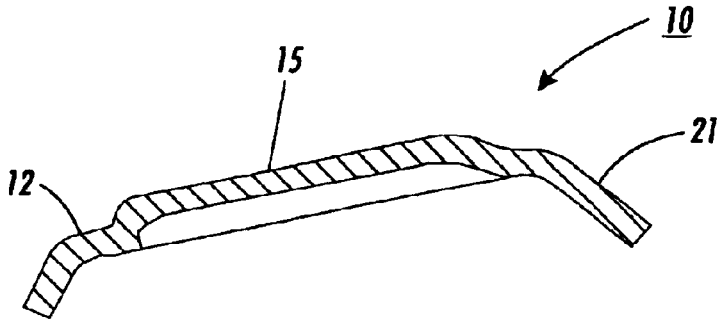
FIG. 4

SUBSTRATE GUIDE MEMBER WITH IMPROVED FLATNESS AND METHOD OF MAKING THE SAME

FIELD OF THE INVENTION

The present invention relates to precision forming of sheet metal and more particularly to a simplified and lower cost method for stamping raised relief features in sheet metal without inducing significant metal stresses that warp the sheet. A particular application is formation of ridges that help guide paper along high speed paper paths formed of sheet metal.

BACKGROUND AND SUMMARY

Pressing or stamping of raised relief features in sheet metal is a common operation used in fabricating many industrial components. In such processes, the sheet metal is stressed as the feature is drawn, or stretched, away from the initial planeness of the base sheet of metal. Such stresses under prior art processes warp the base of sheet metal from which the feature is drawn.

In applications where a high degree of planeness in the base sheet of a sheet metal component is required after the drawing process, prior art methods and procedures have countered the warping of the base sheet through a number of techniques. In one prior art technique, planeness can be improved by stretching the work piece, especially when the stretched sheet is rolled while stretched. U.S. Pat. No. 6,216,521 describes one such process in relation to production processes for hot rolled and quenched metal sheets. Among the shortcomings of this techniques are the requirement for expensive high pressure hydraulic equipment and gripping fixtures as well as indentations or distortions introduced into the part by the gripping fixtures themselves. In another prior art technique to increase planeness, a component is heated to soften the metal before the raised relief feature is drawn. A shortcoming of this second method is that the subsequent cooling process itself may introduce warping in the base sheet. In addition, temperatures that are hot enough to soften the metal may adversely alter the crystalline characteristics of the metal. Yet another prior art technique involves striking, or pushing small "dimples" into the workpiece to introduce surface stresses that offset the stresses previously introduced by the drawing process. Such striking process often requires manual manipulation since variations in the workpiece base substrates make the stresses introduced by drawing irregular. Such manual manipulation takes time, is imprecise, depends greatly upon the intuition and skill of the manipulator, and other ways significantly increases costs while diminishing quality.

One example of a component with raised relief features that requires a high degree of planeness in the base sheet is a substrate guide in a high speed electrostatographic printer. This guide is designed to help position any number of printing cut sheet or web substrates, including paper, transparencies, cut sheets, other plastics and, generally, any planar material suitable for printing. An example of such a paper guide component is shown in FIG. 1. Such a guide component 10 is typically used in the portion of a printer or copier that guides the substrate to the photoreceptor. Raised relief ribs 14–20 and similar ribs are designed to reduce friction as paper slides over guide component 10 as well as to help paper continue in a straight path from paper feed system to the photoreceptor/substrate image transfer area, while inhibiting skew of the paper. Additionally, ribs such as 14–20 reduce the area of contact between guide member 10 and the copy substrate, thereby minimizing the risk that contaminant toner that falls onto guide component 10 will smudge the reverse side of the copy substrate. Ribs 14–16 are skewed in relation to the paper path direction in order to prevent paper edge jamming on rib edges and also to guide paper sizes from A5 to A4, in various registration modes.

FIGS. 2–4 provide close-up and cross-sectional views of guide component 10. In FIG. 2, a series of ribs are shown in detail with cross-sectional perspectives indicated by lines A—A and B—B. FIG. 3 shows the elevated cross-sectional view along line A—A of FIG. 2. In this view, two ribs, 15 and 16 are in raised relief from base sheet 12. FIG. 4 shows the elevated cross-sectional view along line B—B of FIG. 2. This cross-sectional view shows the cross-sectional raised relief profile of rib 15 in relation to base sheet 12. In the embodiment shown in FIGS. 1–4, ribs 14–17 in guide component 10 are in the range of 15 mm long and are drawn in a relief of approximately 1.2 mm above base plate 12. Ribs 14–17 are drawn with a high aspect ratio as shown particularly in FIG. 3. Of course, the shape and dimensions of paper guide components such as guide component 10 with ribs 14–20 vary greatly depending upon the particular apparatus and function that they are to serve.

Under prior art processes, guide component 10 is manufactured in a progressive die cut process as indicated in FIG. 5. This process is conventionally finished with a manual striking process to straighten the part after the progressive cutting and stamping procedures. Moving from right-to-left in FIG. 5, the die cut process begins at step 1 with a blank sheet 50 of stainless steel comprised of 304 alloy or similar material. Piercing slots are first begun in step 2 in a die-cut along the edges leading to a bending and cutting step in step 3 that forms slotted mounting features such as lugs 51 along each side. Another set of piercing cuts are made at step 3 to begin separation of the various guide components 10 from each other. A last separation cut is made at step 4 to separate each guide component 10 except for its end region proximate to mounting lugs 51.

At step 6, ribs such as ribs 14–20 are drawn in a stamping process. In FIG. 5, this drawing process takes several intermediate iterations in order to minimize the stamping force required any one step of the drawing process. At step 7, a striking process is applied by stamping strategically placed dimples into guide component 10 in an attempt to offset the internal stresses causes by drawing step 6. At step 8, the long edges are folded over to increase the end-to end rigidity of guide component 10 and to form crested flat region 21, shown in FIG. 2. At the far left of FIG. 5, mounting lugs 51 are finally free cut to fully separate each guide component 10 from the base sheet 50, thereby to form the completed guide component.

One additional step is generally after the free cut is made. Although the striking step of step 7 attempts to remove stress and to thereby provide straightness along the long dimension of guide component 10, such automated striking process rarely succeeds in obtaining the desired straightness. Accordingly, an additional manual re-striking step is required to obtain the required flatness. This re-striking process adds cost, complexity, and, because it is manually performed, imprecision to the finished guide component 10. The particular purpose of this re-striking process is to remove the stresses introduced along the long dimension of guide component 10 by the drawing process at step 6 that forms the ribs.

Prior art achievement of flatness across the long dimension of various portions of guide component 10 has been difficult. Without hand straightening, typical flatness of a formed guide component 10 under the prior art was as follows:

(A) end-to-end flatness over ribs such as ribs 14–20: ≦3.0 mm;

(B) end-to end flatness of ribbed base sheet 12: ≦3.0 mm; and (C) end-to-end flatness over crested flat region 21: ≦3.0 mm.

The reason for such lack of flatness is that the drawing process stretches metal in the vicinity of the drawn features, thereby creating differential stresses in various regions of the base metal. The result is that drawing the raised relief ribs such as 14–20 not only causes ripples in the ribbed base sheet 12 but, in addition, causes the metal to ripple in the crested flat region 21 as well. With manual straightening using an expensive and tedious striking process, flatness can be improved to the following acceptable levels:

(A) end-to-end flatness over ribs such as ribs 14–20: ≦0.4 mm;

(B) end-to end flatness of ribbed base sheet 12: ≦0.5 mm; and (C) end-to-end flatness over crested flat region 21: ≦0.5–0.75 mm.

For a typical guide component 10 of approximately 320 mm, this means that end-to-end flatness of the critical crested flat region 21 must minimally be maintained within 0.2% (0.751320%). Significant improvements in flatness would be greatly desired. Referring to FIG. 6, the reason that such flatness is important is that guide component 10 acts as an intermediate between the paper feed system and the image transfer stage by guiding the copy substrate to the exact image transfer area at the photoreceptor. Crested flat region 21 of guide component 10 sets the gap through the copy substrate must move, thereby determining the substrate proximity to the photoreceptor. The gap, in turn, is set by fastening lug mounts 51 at the extreme ends of guide component 10. If the 0.2% end-to-end flatness of crested flat region 21 of guide component 10 is not met, then at least portions of the image transfer gap will be either too large or too small.

The particular dimension of the gap is optimized for the substrate size range specified in the machine performance specification. In a typical specification for an electrostatographic printer, the spacing of guide component 10 to the photoreceptor is set at only 0.7±0.2 mm. As discussed above, in order to achieve such flatness, an extra striking step is included in the progressive die press operation of the prior art. This re-striking step introduces extra surface stresses that offset the warping induced by the rib forming. As an extra and as a manual process, this extra straightening process adds the cost of an additional process, including set up, execution, and testing time. Also, additional striking machinery and tooling is required, both of which must be maintained.

As additional background, many prior art processes for stamped and drawn parts provide for cuts and slits to be formed within the base sheet of a part. For instance, sheet metal parts formed into housings for machinery producing heat such as air conditioners have die cut slits that are then bent during a drawing process to form vents. Double slits around raised rib-like parts are also known in sheet metal used as lattice support during construction of plaster-faced walls. In none of these known applications, however, is precision flatness a requirement of the final component.

In sum, considerable advantages over prior art manufacturing techniques for components such as guide component 10 would be realized if any extra straightening process, especially a manual process, could be eliminated and if a simplified and less expensive manufacturing process yielded components with even greater straightness than parts made with prior art processes.

One aspect of the invention is a guide member for guiding a substrate along a paper path, said guide member comprising: (a) a ribbed base sheet having a long dimension and a plurality of end regions; (b) a substrate guide rib formed in raised relief from the ribbed base sheet, said rib having two long and two short sides, each side having a base region; (c) a cut formed along one long side of the rib proximate to the base region of such long rib side; (d) a crested flat region formed parallel to the ribbed base sheet along its long dimension; and (e) mounting fixtures located proximate to the end regions.

Another aspect of the invention is an electrostatographic marking system, comprising a substrate guide member comprising: a ribbed base sheet having a long dimension and a plurality of end regions; a plurality of substrate guide ribs each formed in raised relief from the ribbed base sheet and having two long and two short sides with each side having a base region; a cut formed along at least one long side of each rib proximate to the base region of such long rib side; a crested flat region formed parallel to the ribbed base sheet along its long dimension; and mounting fixtures located proximate to the end regions.

Yet another aspect of the invention is a process for forming a substrate guide member, comprising: forming the flattened outline of the substrate guide member out of sheet metal; cutting a slit in the sheet metal at the location that will become the base of at least one long side of a raised relief rib formed on the substrate guide member; drawing the raised relief rib at the location such that the cut slit is proximate the base of a long side of a raised relief rib; and bending one long edge of the flattened outline to form a crested flat region of the substrate guide member.

BRIEF DESCRIPTION OF THE DRAWINGS

FIG. 3 is an elevated cross-sectional view of a diagonal cross-section of the component in FIG. 1 made using processes of the present invention.

FIG. 4 is an elevated cross-sectional view across a rib and the base sheet of the component in FIG. 1 made using processes of the present invention.

DESCRIPTION

Figure 1:
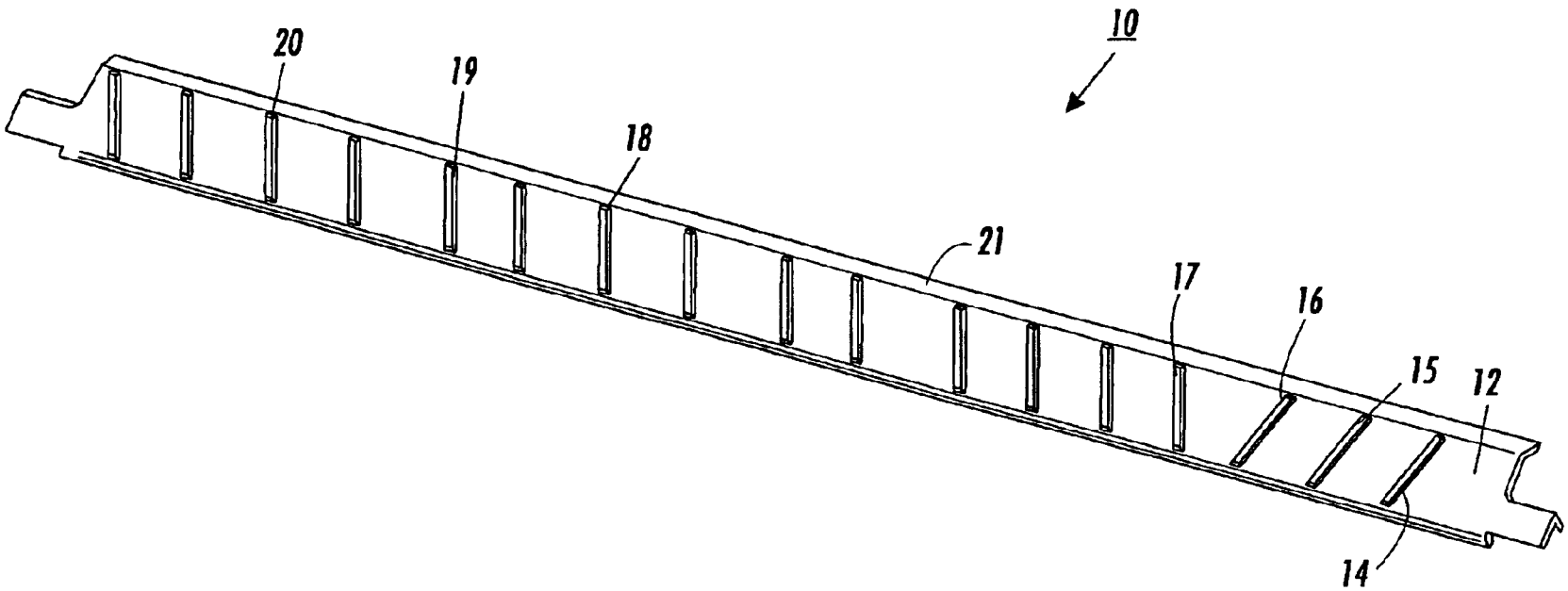
FIG. 1 is an elevated perspective view of a component made using processes of the present invention.

For a general understanding of the present invention, reference is made to the drawings. In the drawings, like reference numerals have been used throughout to designate identical elements.

An exemplary printer system comprising one embodiment of a guide component of the present invention is an multifunctional printer with print, copy, scan, and fax services. Such multifunctional printers are well known in the art and may comprise print engines based upon ink jet, electrostatography such as electrophotography, and other imaging technologies. The general principles of electrostatographic imaging are well known to many skilled in the art. The most common current form is electrophotography. Generally, the process of electrophotographic reproduction is initiated by substantially uniformly charging an electrostatic image forming member which, in electrophotography, is a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrophotographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Such printing processes typically develop toner on the discharged area, known as DAD, or "write black" systems. Light lens generated image systems typically develop toner on the charged areas, known as CAD, or "write white" systems. Embodiments of the present invention apply to both DAD and CAD systems. Since electrophotographic imaging technology is so well known, further description is not necessary. See, for reference, e.g., U.S. Pat. No. 6,069,624 issued to Dash, et al. and U.S. Pat. No. 5,687,297 issued to Coonan et al., both of which are hereby incorporated herein by reference.

Figure 6:
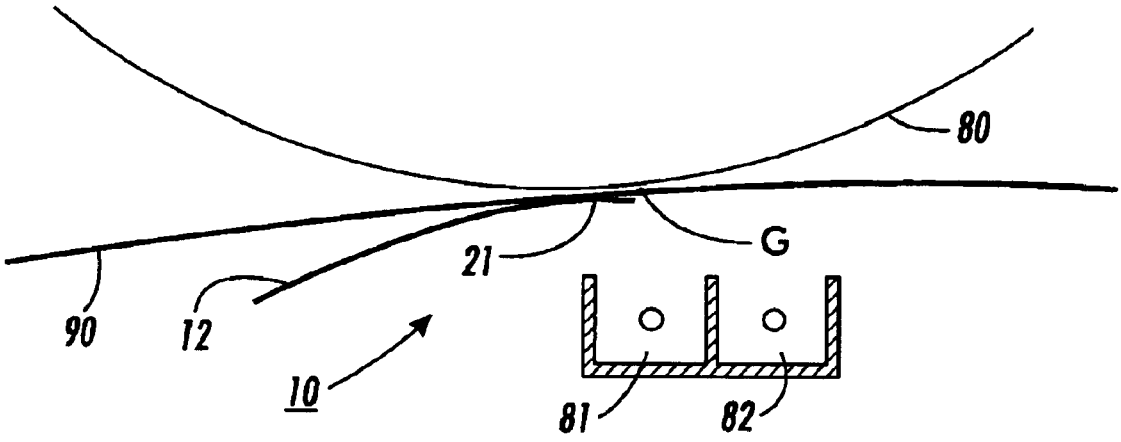
FIG. 6 is an elevated schematic view of an exemplary image transfer station within an electrostatographic printer.

With reference to FIG. 6, a particular placement and function of a guide component 10 is set forth, and a simplified photoreceptor/substrate image transfer system is schematically shown. Prior to this stage of an electrophotographic, printer, photoreceptor 80 has been latently imaged and developed such that it is carrying toner in the image areas. Guide component 10 is positioned proximate to photoreceptor 10 with a gap G therebetween formed by crested flat region 21 of guide component 10. Crested flat region 21 is approximately 4.8 mm wide and formed by a bend in region 13 that orients crested flat region 21 essentially tangentially to photoreceptor 10. Copy substrate 90 is moved toward gap G in synchronous motion with the motion of photoreceptor 80. The convex radius of ribs such as 14–20 serves to minimize the contact area of guide member 10 to the copy substrate yet allows full guidance of the copy substrate into the transfer station. Minimized contact between substrate and guide member 10 is important in order to minimize the risk that free toner contaminants that may have collected onto guide member 10 become attached to the rear side of copy substrate 90. Such avoidance of toner contamination is particularly important in duplex printing. As substrate 90 is moved proximate to guide component 10, sloping ribbed base sheet 12 and ribs including ribs 14–20, guides the leading edge of substrate 90 toward and through gap G.

Corotron 81 is positioned behind guide component 10. Corotron 81 is charged with the same charge polarity as photoreceptor 80, and a portion of its charged corona is captured and contained by the metal of guide component 10. As substrate 90 moves past gap G, it becomes exposed to that portion of the corona from corotron 81 that was not shielded by guide component 10. Guide component 10 thus guides both substrate 90 and also the corona of corotron 81. Hence, guide component 10 is often called a "halo guide". As a section of substrate 90 exits gap G, it becomes exposed to the unshielded corona from corotron 81. In the narrow region that is unshielded by guide component 10, the corona charges substrate 90 to the same polarity and to a greater potential than the charge potential of photoreceptor 80. The result is that the toner, which is of opposite polarity, is drawn, or transferred from photoreceptor 80 to substrate 90 within a narrow, controlled region. As the imaged portion of substrate 90 moves further past gap G, the now imaged region of substrate 90 becomes exposed to the opposite charge polarity of detact corotron 82. This opposite polarity lessens the attraction between substrate 90 and photoreceptor 80, thereby enabling the clean detact, or separation between photoreceptor and substrate.

The above description provides further information regarding the reasons that crested flat region 21 of guide component 10 must maintain a gap G of 0.7±0.2 mm over its entire length. If the gap G between photoreceptor 80 and guide component 10 is too small, then the likely result will be contamination and scratching of the photoreceptor plus jamming of the substrate within gap G. If gap G is too large, then image halo defects are likely to result since the corona from corotron 81 becomes less shielded and the substrate less constrained. The result is that the image transfer zone becomes uncontrolled.

Figure 2:
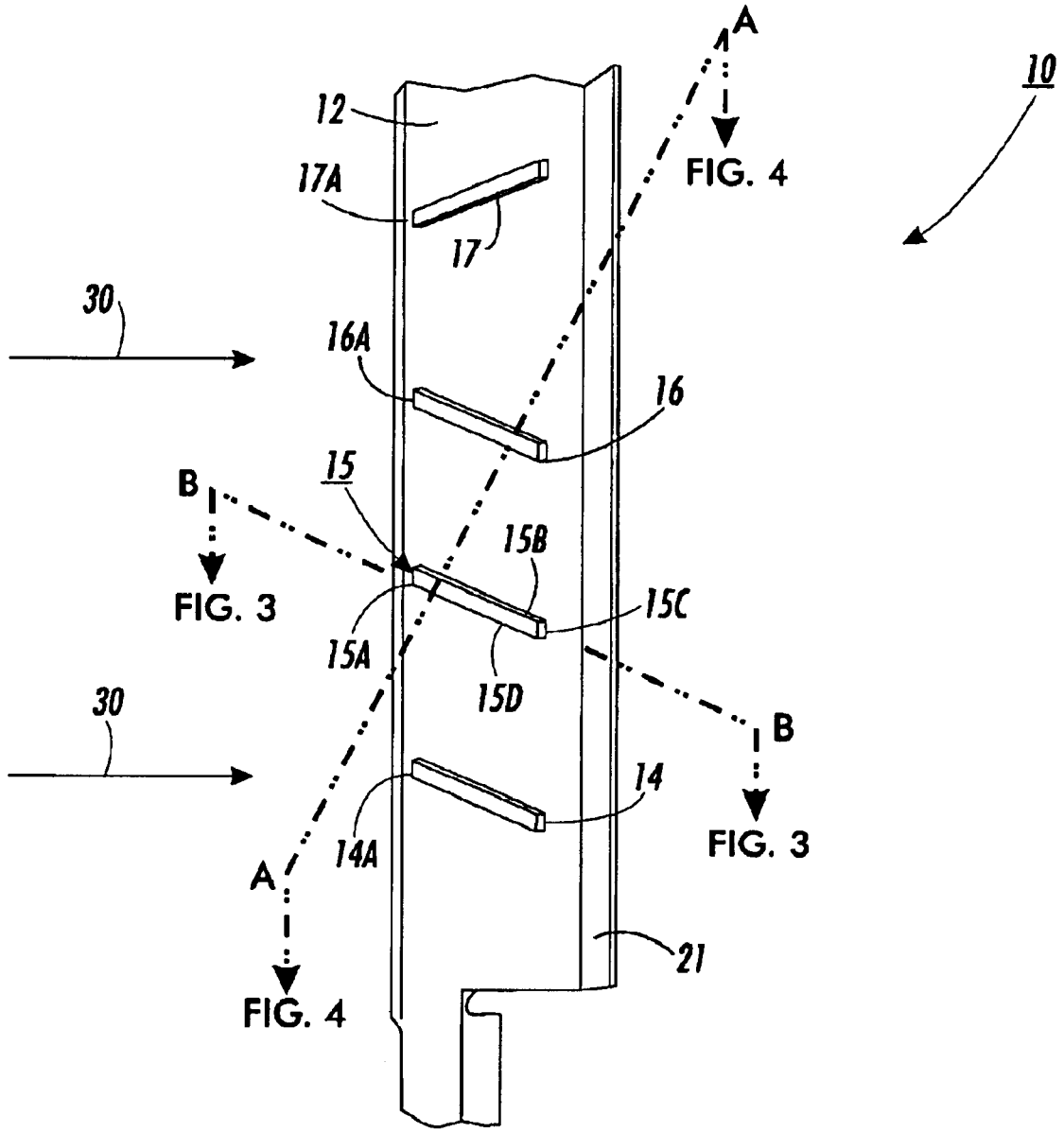
FIG. 2 is an elevated perspective view of a portion of the component shown in FIG. 1 made using processes of the present invention.

Turning again to exemplary guide component 10 shown in FIG. 1, typical dimensions of each of ribs 14–20 are approximately 15 mm long×2 mm wide with a top surface formed to a radius of approximately 10 mm. One embodiment of the present invention recognizes that substrate 90 moves over guide component 10 essentially orthogonally with respect to the long axis of guide component 10 as such paper direction is indicated by arrows 30 in FIG. 2. Accordingly, of the four sides of rib 15 labeled 15A–15D in FIG. 2, only the two short sides, 15A and 15C, make contact with the substrate moving over guide component 10. Rib 15 is illustrative of each rib on guide component 10. After contacting leading sides, 14A–17A, of ribs 14–17, the paper rides over the top of each rib without contacting the two long sides, 15B and 15D. Thus, only the leading and trailing sides plus the top of each rib contacts the moving paper, Features along the long sides do not affect the function of guide component 10 provided that such features do not interfere with the substrate path.

Figure 5:
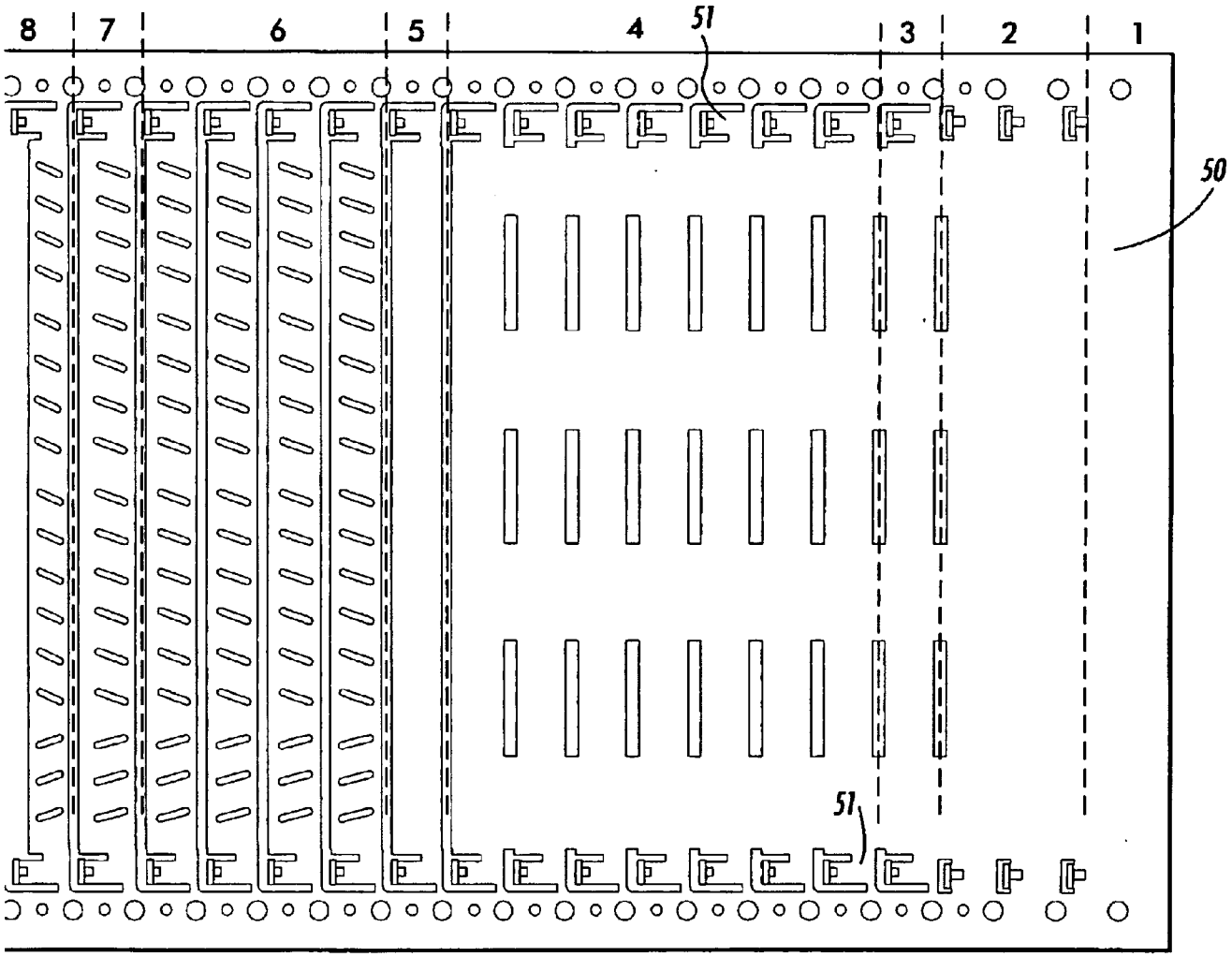
FIG. 5 (Prior Art)
FIG. 5 is an elevated plane view of a sheet metal substrate undergoing the progressive die-cutting process of the prior art.
Figure 7:
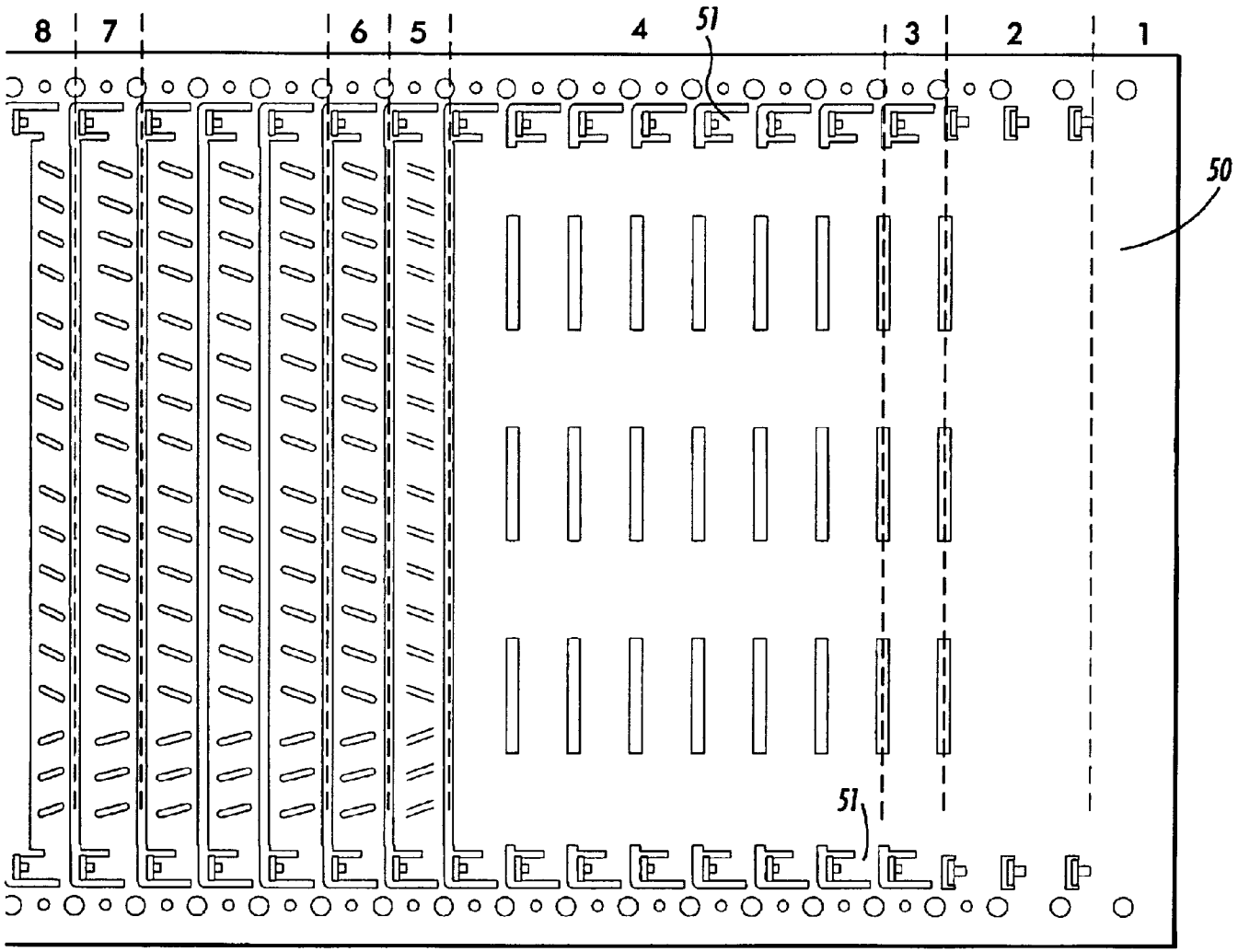
FIG. 7 is an elevated plane view of a sheet metal substrate undergoing a progressive die-cutting process using one embodiment of the invention.

One embodiment of the innovative process of the present invention will now be explained with reference to FIG. 7. FIG. 7 resembles FIG. 5 except for a critical difference reflected in the result of process step 5. In other words, the process of progressively die-cutting and folding mounting lugs 51 and cutting initial separation bands in steps 14 are the same. At step 5, however, the long sides of each rib have been sheared by the same cutting die that sheared the raw sheet into the shape shown in conventional step 5 which completed basic separation of each of the guide components 10. Thus, the process of forming guide component 10 using the present invention requires no additional processes other than the normal die cut processes of the prior art. As explained in relation to step 6, in fact, fewer process steps are required. Additionally, the invention results in considerable cost and quality advantages over the prior art.

After raw guide component 10 is die cut as shown in step 5 of FIG. 7, ribs such as 14–20 are formed in a pressing, or drawing, die in process step 6 which draws the ribs into their final raised relief profile. Compared to the step 6 shown in FIG. 5, the step 6 in FIG. 7 comprises only one intermediate step. This improvement results because the cut slits greatly reduce the resistance to the stamping force, thereby eliminating the need for progressive intermediate drawing steps. The drawing process of step 6 may use the same die as the conventional prior art process but the result is markedly different from the result of prior art processes. Specifically, the following end-to-end flatness of guide component 10 can be maintained during the drawing process as follows:

(A) end-to-end flatness over ribs such as ribs 14–20: ≦0.4 mm, (B) end-to end flatness of ribbed base sheet 12: ≦0.4 mm; and (C) end-to-end flatness over crested flat region 21: ≦0.3 mm.

Thus, compared to the prior art, flatness after the drawing process and before any striking process is equal to the prior art flatness over the ribs and better than prior art flatness over the ribbed base sheet and the crested flat region. Indeed, end-to-end flatness over the important crested flat region 21 is improved to 0.09%, or approximately twice the flatness achievable under the prior art even using 'striking' or manual straightening processes after drawing is completed. This much greater precision in flatness using the inventive process makes the subsequent striking process shown in step 7 of FIG. 7 entirely optional. This automated striking process in FIG. 7 is accordingly usually omitted.

The superior flatness resulting from this embodiment of the invention is the result of imparting less stress to base sheet 12 as ribs such as 14–20 are drawn by the drawing die. In prior art processes without shearing of long rib sides similar to 15B and 15D, metal is stretched and drawn from all 4 sides of each of ribs such as 14–20. This stretching deforms and stresses the surrounding metal in ribbed base sheet 12, resulting in the warping that requires subsequent straightening by processes such as striking, forming, and similar straightening processes. In contrast, using the invention, only a small amount of metal in the regions of short sides such as 15A and 15C are stretched and stressed. Since the substrate guide function of guide component 10 only requires connection between short rib sides such as 15A and 15C and ribbed base sheet 12 and since a gap along long rib sides such as sides 15B and 15D does not risk catching or otherwise interfering with the flow of paper or other substrates over the top of ribs such as rib 15, the shearing of sides 15B and 15D does not detract from the function of guide component 10. Moreover, attachment of ribs such as 14–20 by only their short sides provides enough rigidity with 1.0 mm sheet metal to hold the top surface of ribs 14–17 in place.

In sum, embodiments of the present invention require fewer processes and achieve greater final flatness along the crested flat region of guide component 10 and along the ribbed base sheet 12 than processes of the prior art. Performance of parts such as guide component 10 that require precise flatness is accordingly increased. Costs of manufacturing parts such as guide component 10 decrease due to savings in labor costs, elimination of the need for special straightening equipment and special straightening dies and tools, and less work-in-process inventory that results from decreased time for manufacture.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A guide member for guiding a substrate along a paper path, said guide member comprising:

a. a ribbed base sheet having a long dimension and a plurality of end regions;

b. a substrate guide rib formed in raised relief from the ribbed base sheet, said rib having two long and two short sides, each side having a base region;

c. a cut formed along one long side of the rib proximate to the base region of such long rib side;

d. a crested flat region formed parallel to the ribbed base sheet along its long dimension; and e. mounting fixtures located proximate to the end regions.

2. The substrate guide member of claim 1, further comprising a cut along substantially both long sides proximate to the base region of each such long side.

3. The substrate guide member of claim 1 wherein the crested flat region has a long dimension and wherein flatness of the crested flat region along its long dimension exceeds about 0.12 percent.

4. The substrate guide member of claim 1, wherein the crested flat region has a long dimension and wherein flatness of the crested flat region along its long dimension exceeds about 0.09 percent.

5. The substrate guide member of claim 1, further comprising:

a plurality of substrate guide ribs each formed in raised relief from the ribbed base sheet and having two long and two short sides with each side having a base region; and b. a cut formed along at least one long side of each rib proximate to the base region of such long rib side.

6. The substrate guide member of claim 1, wherein the cut is formed along substantially the entire length of the long side.

7. The substrate guide member of claim 1, wherein the substrate guide member is comprised of sheet metal that has been formed into the substrate guide member.

8. The substrate guide member of claim 1, wherein the substrate guide member comprises a halo guide within an electrostatographic marking system.

9. The substrate guide member of claim 1, wherein the substrate guide rib has a curved top surface for minimizing contact with the substrate.

10. The substrate guide member of claim 1, wherein the ribbed base sheet has a long dimension and wherein flatness of the ribbed base region along its long dimension exceeds 0.125 percent.

11. The substrate guide member of claim 1, further comprising at least 3 guide ribs each formed in raised relief from the ribbed base sheet, each such rib having an apex, wherein flatness can be measured along the apex of multiple guide ribs and wherein the flatness measured along the multiple guide ribs exceeds 0.125 percent without applying manual straightening processes.

12. An electrostatographic marking system, comprising a substrate guide member comprising:

a ribbed base sheet having a long dimension and a plurality of end regions;

a plurality of substrate guide ribs each formed in raised relief from the ribbed base sheet and having two long and two short sides with each side having a base region;

a cut formed along at least one long side of each rib proximate to the base region of such long rib side;

a crested flat region formed parallel to the ribbed base sheet along its long dimension; and mounting fixtures located proximate to the end regions.

13. The electrostatographic marking system of claim 12, further comprising a cut along substantially both long sides of each rib proximate to the base region of each such long side.

14. The electrostatographic marking system of claim 12, wherein the crested flat region has a long dimension and wherein the flatness of the crested flat region along its long dimension exceeds about 0.12 percent.

15. The electrostatographic marking system of claim 12, wherein the crested flat region has a long dimension and wherein the flatness of the crested flat region along its long dimension exceeds about 0.09 percent.

16. The electrostatographic marking system of claim 12, wherein the cut is formed along substantially the entire length of each long side.

17. The electrostatographic marking system of claim 12, wherein the substrate guide member is comprised of sheet metal that has been formed into the substrate guide member.

18. The electrostatographic marking system of claim 12, wherein the substrate guide member comprises a halo guide.

19. The electrostatographic marking system of claim 12, wherein the electrostatographic marking system is an electrophotographic marking system.

20. The electrostatographic marking system of claim 12, further comprising an electrostatic image forming member and wherein the crested flat region of the substrate guide member is positioned within about 0.7±0.2 millimeters of the electrostatic image forming member.

21. The electrostatographic marking system of claim 20, wherein the electrostatic image forming member is a photoreceptor.

22. A process for forming a substrate guide member, comprising:

forming the flattened outline of the substrate guide member out of sheet metal;

cutting a slit in the sheet metal at the location that will become the base of at least one long side of a raised relief rib formed on the substrate guide member;

drawing the raised relief rib at the location such that the cut slit is proximate the base of a long side of a raised relief rib; and bending one long edge of the flattened outline to form a crested flat region of the substrate guide member.

23. The process of claim 22, further comprising cutting a plurality of slits in the sheet metal at locations that will become the base of a plurality of long sides of a raised relief rib.

24. The process of claim 22, further comprising forming mounting features proximate to each end of the long dimension of the substrate guide member.

25. The process of claim 22, wherein the forming, cutting, drawing, and bending are performed in a progressive die process.

26. The process of claim 25, wherein the drawing process comprises a single drawing operation.

27. The process of claim 25, further comprising mounting rolled sheet metal into loading fixtures for feeding the progressive die process.

28. The process of claim 22, further comprising:

making a plurality of substrate guide members from a sheet of metal; and separating the substrate guide members after bending of the long edge to from the crested flat region.

29. The process of claim 22, further comprising a non-manual straightening process.

30. The process of claim 22, wherein the crested flat region of the substrate guide member is flat across its long dimension within about 0.12 percent without using manual straightening operations.

31. The process of claim 22, wherein the crested flat region of the substrate guide member is flat across its long dimension within about 0.09 percent without using manual straightening processes.

32. The process of claim 22, wherein forming the flattened outline comprises die cutting.

* * * * *